United States Patent [19]

Smith

[11] Patent Number: 4,567,808

[45] Date of Patent: Feb. 4, 1986

[54] FOOT OPERATED BASS DRUM PEDAL

[76] Inventor: Peter L. Smith, 36 Tahattawan Rd., Box 443, Littleton, Mass. 01460

[21] Appl. No.: 671,737

[22] Filed: Nov. 15, 1984

[51] Int. Cl.[4] ..... G10D 13/02

[52] U.S. Cl. ..... 84/422 R

[58] Field of Search ..... 84/422 R, 422 C, 422 H

[56] References Cited

U.S. PATENT DOCUMENTS

| | | | |
|---|---|---|---|
| 902,444 | 10/1908 | Pettingell | 84/422 C |
| 1,479,376 | 1/1924 | Danly | 84/422 C |
| 3,055,254 | 9/1962 | Haviland | 84/422 R |
| 3,797,356 | 3/1974 | Duffy et al. | 84/422 R |
| 4,235,146 | 11/1980 | Purdy | 84/422 R |
| 4,346,638 | 8/1982 | Hoshino | 84/422 R |

*Primary Examiner*—Lawrence R. Franklin

[57] ABSTRACT

A foot-operated bass drum pedal is disclosed with an axial means which rolls toward and away from the bass drum head. Means comprise of a shaft with pinions which rolls in a straight line along a horizontal plane provided by pinion racks resting in platforms supported by vertical standards. The shaft with pinions rolls toward the bass drum by depression of a pedal via linkage and rolls away from the bass drum by release of the pedal via tension springs thereby co-axially and cycloidally rotating a beater in and out of a vertical strike position.

20 Claims, 4 Drawing Figures

FOOT OPERATED BASS DRUM PEDAL

TECHNICAL FIELD

The present invention relates to the field of percussion where a vertically positioned bass drum is played with the foot and particularly, to the foot-operated bass drum pedal used for this purpose characterized in the axial means and mode of rotation thereof.

BACKGROUND ART

The conventional foot-operated bass drum pedal includes a frame element, a pedal element, a linkage means, and resilient means which provide and rotate an axial means whereby the beater element is co-axially rotated in and out of strike position.

Prior art has offered a wide variety of axial means but one has become a standard of the art. An example of the standard axial means can be found in U.S. Pat. No. 4,186,644 where "a bearing is mounted atop the cylindrical post of the pedal frame and rotatably carries a main shaft extending substantially horizontally." Another example can be found in U.S. Pat. No. 4,346,638 which has "support poles disposed on both sides of the base, ball bearings mounted respectively on the upper ends of the poles and a rotary shaft disposed between the ball bearings." In both these cases the shaft, which serves to rotate the beater element, is held in a stationary position by the frame element and bearings. Although this mode of axial rotation has served the prior art well, it does have its limitations and inherent problems.

One such problem is due to the downward pull of linkage in relation to the weight of the beater element, extending co-axially from the shaft. The force required to equal the weight of the beater is centered on the lower portion of the radial bearings rather than being evenly distributed. This results in resistance, which requires a greater initial force and results in a snapping quality rather than a smooth even rotation. The uneven distribution of force also results in uneven wear of the radial bearings.

Another problem inherent in prior art is due to the clamping element which secures the frame element to the bass drum hoop and to the stationary rotation of the shaft. The prior art has found it necessary to position the frame element an undesirable distance from the bass drum head. As illustrated in U.S. Pat. No. 4,235,146, this results in the beater element rotating beyond its vertical balance point and striking the bass drum head at an angle. At strike position the weight of the beater works negatively against the resilient means, thus resulting in a slower retraction of the beater element. Also, the angular strike position results in poor sound quality, less volume, and damage to the drum head.

Still, another problem inherent in prior art is due to the stationary position of the rotary shaft and the forward arc of the pedal element which causes the angle of pull on the linkage means to change as the pedal element is depressed to rotate the shaft. This change in the angle of pull greatly alters the degree of force transmitted by linkage to the shaft.

Of all the problems in the prior art, the most annoying is the noise emanating from the bearings as a result of the shock caused by the beater element striking the bass drum head, and as a result of loose bearings caused from the uneven wear mentioned earlier. This is most undesirable, especially in recording situation where a microphone is positioned adjacent the bass drum head where it can easily pick up and amplify any sound emanating from the pedal.

It will be the object of the present invention to eliminate the problems inherent in prior art by providing an improved axial means, and rotation thereof, for the purpose of providing true coordination between all moving elements.

DISCLOSURE OF THE INVENTION

The principal object of the now disclosed foot-operated bass drum pedal is to provide an axial means comprising of a rolling means which rolls in a forward and backward direction along a track means for the purpose of providing the beater with a cycloidal stroke.

Another object of the present invention is to have coordination between the forward distance rolled by the rolling means and the co-axial rotation of the beater, whereby the rolling means is in a vertical line below the beater, thus providing a vertical strike position for the purpose of preventing negative beater weight resulting in quicker response, better sound quality, more power and less damage to the bass drum head.

A further object of the present invention is to have coordination between the forward distance rolled by the rolling means and the forward arc of the pivotal pedal for the purpose of maintaining a consistent angle of pull on the linkage means, thereby transmitting a consistent degree of force to the rolling means.

Still another object of the present invention is to provide covers for the purpose of preventing disengagement of the rolling means from the track means and to muffle noise, if any, caused by the rolling means rolling along the track means.

In accordance with the present invention, the rolling means and the track means comprise of an axle with pinions fixed to each and which rolls in a straight line along a horizontal plane provided by pinion racks which rest in channels provided by platforms integral with support means. The shaft with pinions rolls forward along the pinion racks by depression of an inclined pedal, via linkage means, thereby cycloidally rotating the beater into a vertical strike position. Likewise, the shaft with pinions rolls backwards by release of the pedal, via resilient means, thereby cycloidally rotating the beater out of vertical strike position and into a rest position.

BEST MODE FOR CARRYING OUT THE INVENTION

To assure proper interpretation of present invention, it is to be understood that the terms Front and Forward refer to those parts which are adjacent to or move in the direction of the base drum head and the terms Back and Backward refer to those parts which are adjacent to the operator or move in the direction going away from the bass drum head.

A description of the preferred embodiment of the present invention is now described referring to FIGS. 1 thru 4.

Figure 1:
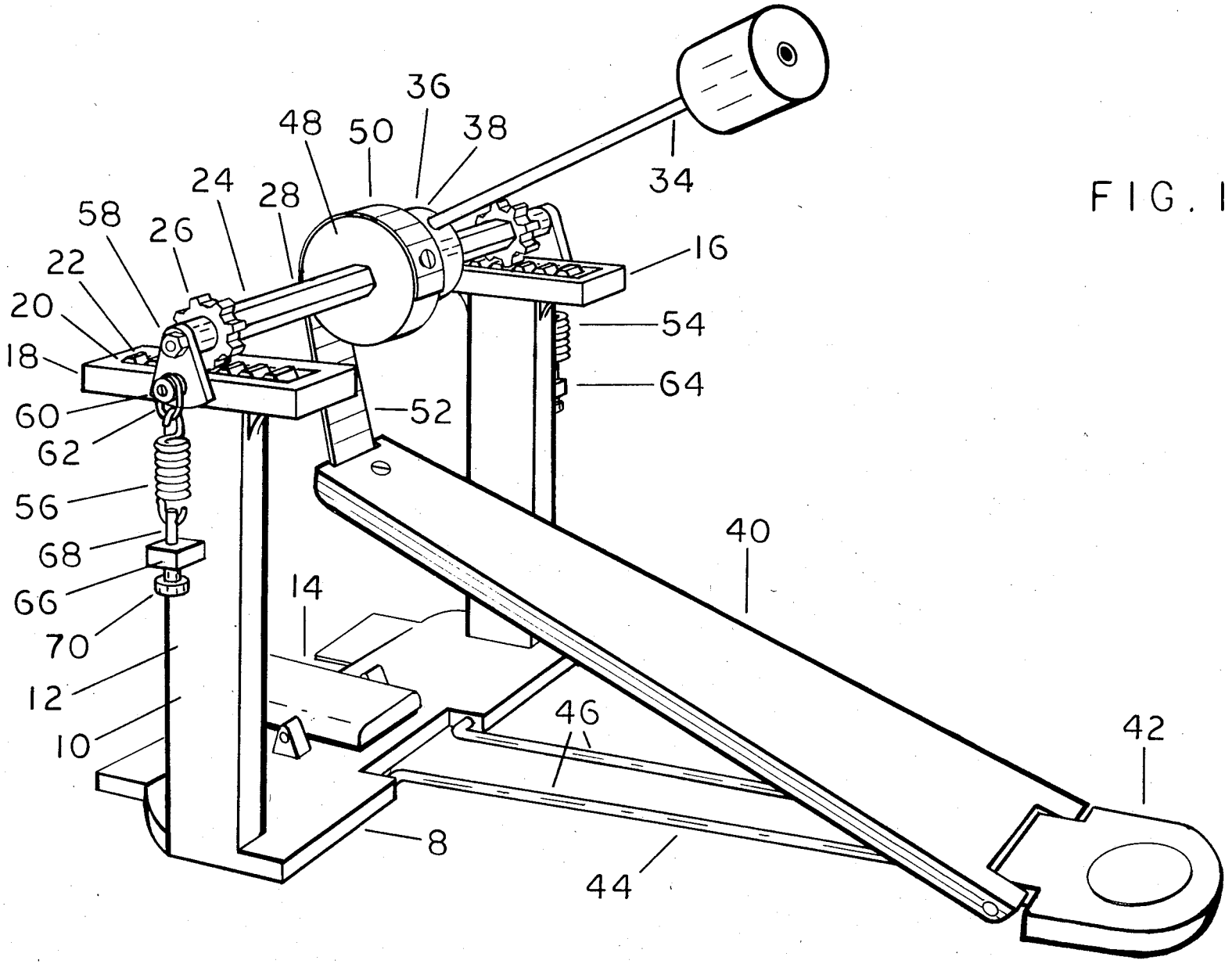
FIG. 1, is a perspective view of the present invention in rest position showing preferred embodiment.

A foot-operated bass drum pedal as shown in FIG. 1, comprising a base 8, supported by the floor, with support means 10, extending vertically from the base 8 comprising of spaced vertical standards 12 disposed on each side of the base 8 and of the same casting. A pivotal clamp 14 is provided by the base 8, preferably between the spaced vertical standards 12 for securing the front of the base 8 to the hoop of a vertically positioned bass drum (not shown).

Figure 3:
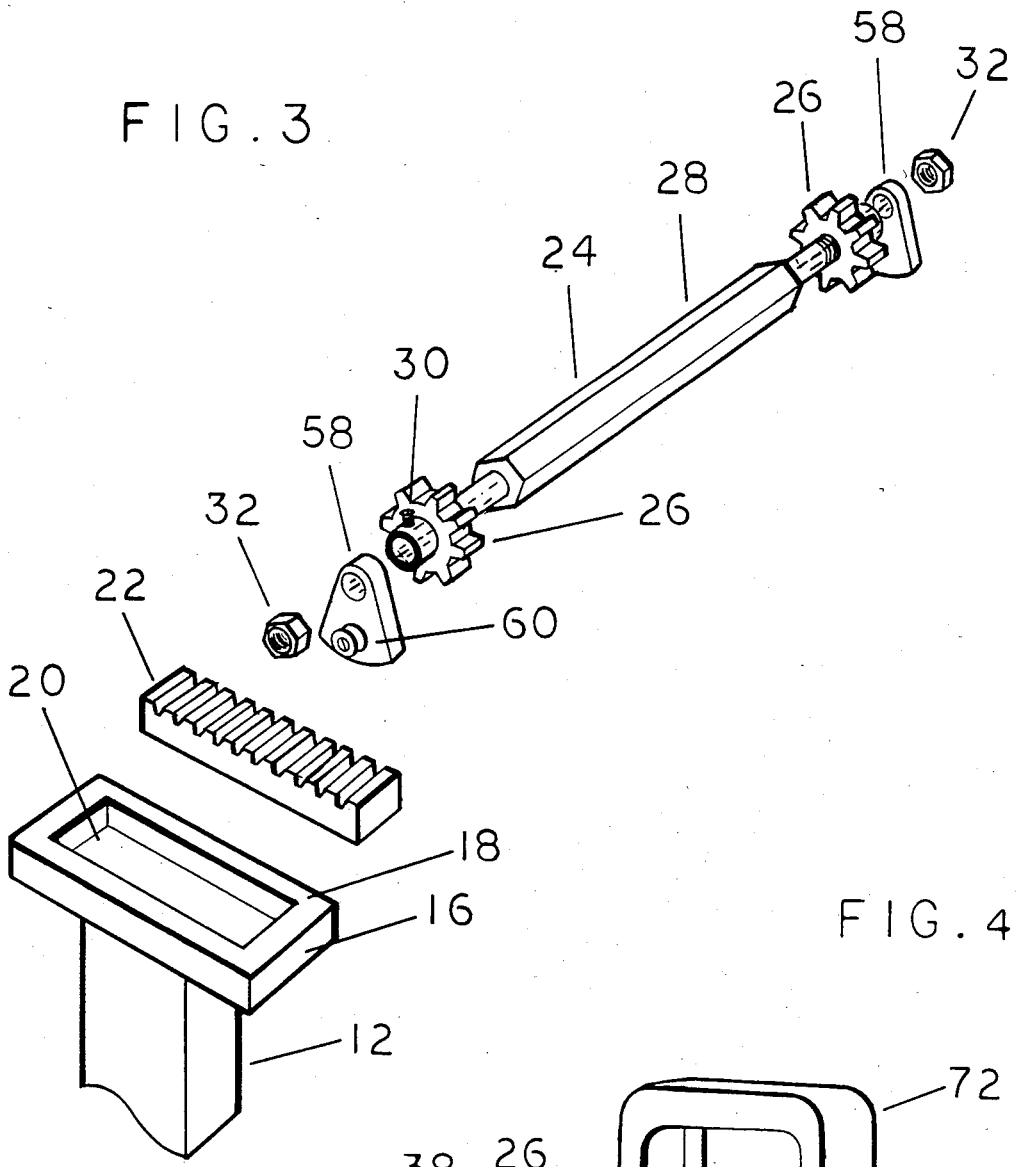
FIG. 3, is an exploded view in perspective of the preferred embodiment.

As shown in FIGS. 1 and 3, a track means 16 is provided by the spaced vertical standards 12 and preferably comprises of spaced platforms 18, channels 20 extending along the center of the spaced platform 18 and spaced pinion racks 22 which rest securely in the channel 20. The platforms 18 should extend in the forward and backward direction and be of a horizontal plane to accommdate the forward and backward roll of the rolling means 24.

The channels 20 should be parallel and have dimensions equal to the pinion racks 22 so that their sides are level with the teeth of the pinion racks 22. The pinion racks 22 are held stationary in the channels 20 with their teeth running in the axial direction of the rolling means 24. The space between the teeth of the pinion racks 22 should be below the surface of the platforms 18, thus preventing the rolling means 24 from sliding sideways in the axial direction.

As shown in FIGS. 1 and 3, the rolling means 24, which rolls in a straight line along the track means 16, preferably comprises spaced pinions 26 joined by an axle, which is preferably a hexagonal shaft 28. The pinions 26 are of a spacing equal to that of the pinion racks 22 and are securely fixed to the shaft 28 so that they co-axially rotate in unison with the shaft 28.

In FIG. 3 it is observed that the pinions 26 are provided with a central bore and a set screw 30. The ends of the shaft 28 are rounded to coincide with the central bore of the pinions 26 and threaded to receive hex-nuts 32. The pinions 26 are aligned with each other so that their teeth run in the axial direction and are held in alignment by tightening the set screw 30. Preferably, the ends of the shaft 28 provide holes or are notched to receive the set screws 30 and thus further prevent slippage and maintain alignment. The pinions 26 with shaft 28 should now align and meshingly engage with the pinion racks 22 and the teeth of the pinions 26 should be partially below the surface of the platform 18.

A beater 34, which is well known to the art, is adjustably fixed by its stem to a beater mounting means 36 comprising of a hub 38, which is fixed by a central hexagonal bore to the hexagonal shaft 28. The hub 38 is positioned between the spaced pinions 26 and co-axially rotates in unison with the shaft 28 and the pinions 26. The hub 38 is provided wih a hole running transverse to its axis and a thumb screw to intersect the hole (not shown). As observed in FIGS. 1 and 2, the stem of the beater 34 is inserted through the hole of the hub 38 and held at the desired length by tightening the thumb screw, thus coaxially rotating in unison with the shaft 28 and the pinions 26.

Figure 2:
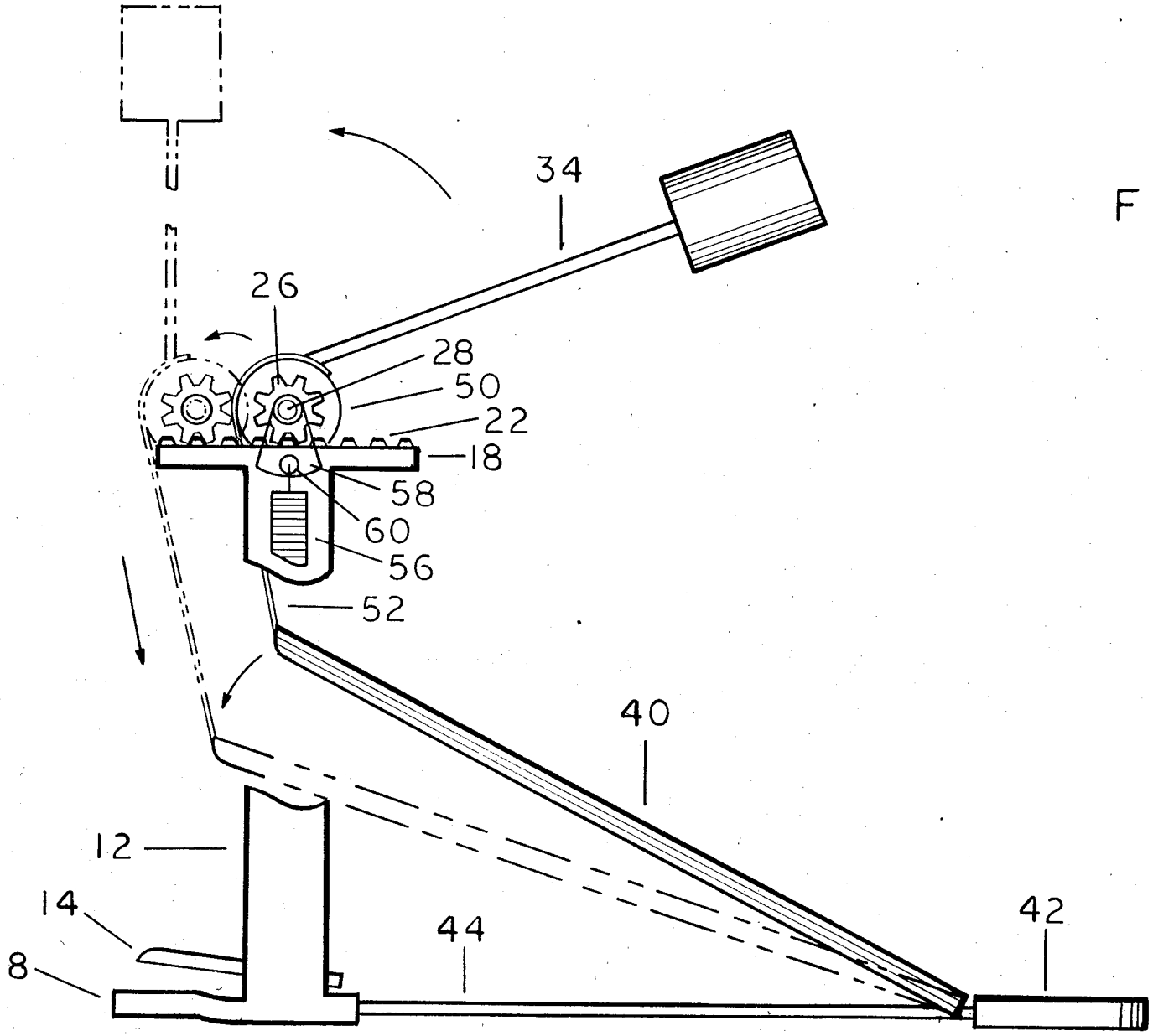
FIG. 2, is a side view of present invention showing the movement of preferred embodiment in phantom.

An inclined pedal 40, as shown in FIGS. 1 and 2, is provided with a heel plate 42 which is pivotally joined to the back of the pedal 40. The front of the inclined pedal 40 is positioned below the rolling means 24 by a spreader 44. The spreader 44 is fixed to the bottom of the heel plate 42 and comprises resilient arms 46 that maybe removably joined to the back of the base 8 or, as in prior art, to the back of the spaced vertical standards 12.

Torque is provided by an eccentric means 48, which comprises a cam 50 as shown in FIG. 1. Like the beater mounting hub 38, the cam is also fixed to the hexagonal shaft 28 by a central bore and is positioned adjacent to the heater hub 38 in line with the front of the inclined pedal 40 where it co-axially rotates in unison.

The means to link the cam 50 to the front of the inclined pedal 40 comprises of a flexible strap 52 which, as seen in FIGS. 1 and 2, wraps around the cam 50 and is adjustably fixed to cam 50 and pedal 40 by suitable means. The flexible strap 52, should be of material resistant to stretching.

The rolling means 24 is retracted by resilient means 54 which are eccentrically joined below the rolling means 24, thus maintaining engagement with the track means 16 and establishing the rest position. The resilient means 54 preferably comprise tension springs 56, vertically disposed adjacent the spaced vertical standards 12, and sectors 58 fixed adjacent to the pinions 26 by the hex-nuts 32. As observed in FIGS. 1 and 3, the sectors 58 are in a downward position and are axially extended to provide clearance with the outer sides of the platforms 18. The sectors 58 carry a boss 60 at their periphery to hold a loop 62 which serves as a coupling between the top of the tension springs 56 and the eccentrically positioned boss 60. The sectors 58 co-axially rotate in unison with the rolling means 24, thereby rotating the bosses 60 cycloidally which in turn pull on the tension springs 56 via the coupling loops 62.

A tensioning means 64 is provided below each of the vertically disposed tension springs 56 and comprises brackets 66, which extend axially from the outer sides of the spaced vertical standards 12, and tension screws 68 with a knurled nut 70. The bottom of the tension springs 56 is suitably joined to the top of the tension screws 68 which go through their brackets 66 to receive the knurled nuts 70 on the bottom side of the brackets 66, whereby tension is provided by tightening of the knurled nuts 70.

Figure 4:
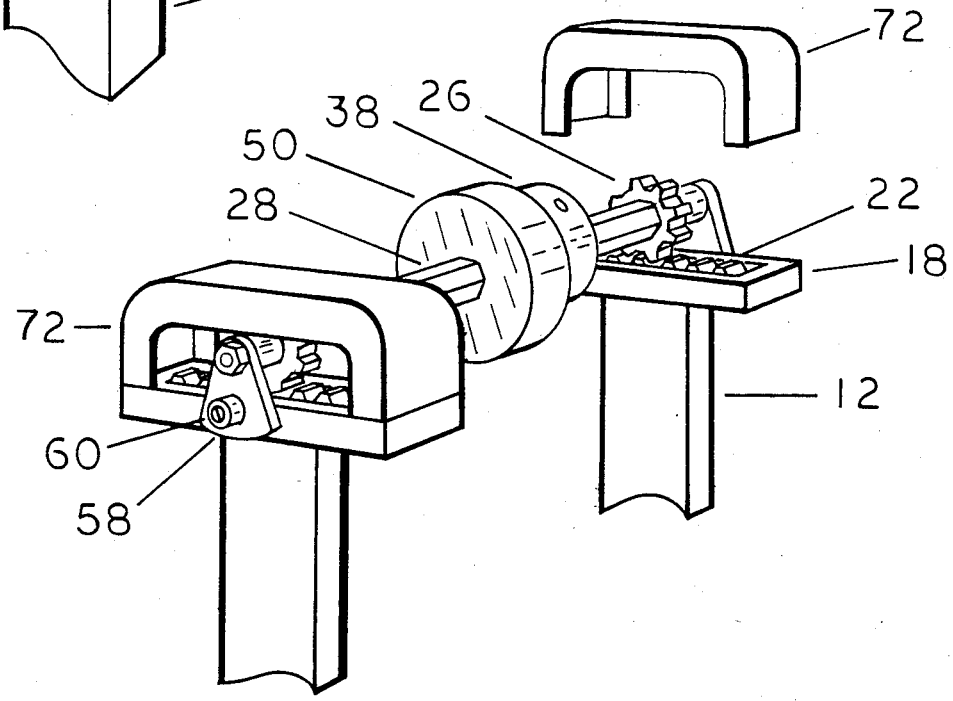
FIG. 4, is a perspective view showing the covers for the preferred embodiment.

In accordance with the invention, means are provided to prevent disengagement comprising covers 72, which are removably fixed to the platforms 18 and enclose the pinions 26 and pinion racks 22. As shown in FIG. 4, the sides of the covers 72 are cut away to allow the pinions 26 and shaft 28 to roll in a forward and backward direction without obstruction. In order to prevent disengagement, the clearance between the top of the covers 72 and top of the pinions 26 should be less than the size of pinion teeth 26, thus preventing the teeth of the pinions 26 and the teeth of the pinion racks 22 from disengaging. The covers 72 further provide a means for protection and act as muffles.

The operation of the present invention is now described referring to FIG. 2, which shows the foot-operated bass drum pedal in rest position with the sectors 58 down, the pedal 40 at approximately a 45 degree angle and the beater 34 at no less than a 45 degree angle of the pedal 40.

By depression of the pedal 40, the connecting strap 52 pulls on the cam 50, causing the shaft 28 and pinions 26 to roll forward along the pinion racks 2, thereby cycloidally rotating the beater 34 into a vertical strike position (shown in phantom). As the shaft 28 rolls with the pinions 26 the sectors 58 also co-axially rotate causing the eccentrically carried bosses 60 to move cycloidally, thereby providing a a generally vertical pull on the tension springs 56.

By releasing the pedal 40, the pull of the tension springs 56 on the sectors 58 causes the shaft 28 and pinions 26 to roll backward thereby raising the pedal 40, via the connecting strap 52, and cycloidally rotating the beater 34 out of the vertical strike position and back to the rest position.

The forward distance rolled by the shaft 28 and pinions 26 is co-ordinated with the cycloidal rotation of the beater 34 whereby the shaft 28, carrying the beater 34, is in a vertical line below the beater 34 resulting in a vertical strike position. The vertical strike position prevents negative beater weight (which occurs when the beater 34 rotates beyond its vertical balance point) resulting in quicker response, better sound quality, more power and less damage to the bass drum head.

Co-ordination is accomplished by releasing the tension springs 56, disengaging the pinions 26 and shaft 28 from the pinion rack 22, positioning the pinions 26 and shaft 28 either closer or farther away from the bass drum head, and re-tensioning the tension springs 56, thus establishing a new rest position.

The forward distance rolled by the pinions 26 and the shaft 28 is also co-ordinated with the forward arc of the inclined pedal 40 resulting in a consistent angle of pull on the connecting strap 52 whereby a consistent degree of force is transmitted by the strap 52 to the cam 50. This is accomplished by co-ordinating the size of the pinion 26 with the size of the cam 50.

It is to be understood that the present invention is not limited to the precise construction herein described and illustrated in the accompanying drawings. Numerous modifications and variations are possible without departing from the spirit of the invention. For example:

1. A metallic casting comprising of the pinion, shaft, cam, beater mount, and sectors with bosses may provide a means to integrate these parts and thus prevent any slippage which could occur at the joining areas. The casting would provide all the functions of integrated parts.
2. A metallic casting as in example 1 but not including the sectors with bosses.
3. A metallic casting as in example 2 but not including the pinions.
4. The pinions or any fashionings thereof may be circular segments rather than fully circular in section.
5. Rather than spaced pinions joined by a shaft, a cylinder may serve the same function. The teeth provided by the cylinder could either be at the ends or run the length of the cylinder. Cylinder may also be circular in section or a segment thereof.
6. A cylinder as described in example 5 may be provided with a hole running transverse to the axis and a thumb screw, whereby the stem of the beater may be adjustably fixed, thus eliminating the need for a beater mount. Also, the cylinder may be provided with suitable means for adjustably fixing the connecting straps.
7. The circumference of any rolling means may either totally or partially provide teeth.
8. The teeth may be provided by means of a covering or sleeve, i.e., nylon, which may be totally or partially toothed.
9. Rather than sectors, brackets or any other suitable means may be used. Also, a plurality of holes may be provided at the periphery whereby the boss may be selectively positioned to adjust beater angle and rest position.
10. If the pinions, fashionings thereof, or cylinder are large enough, a boss or other suitable means may be eccentrically fixed to the side, thus eliminating the need for sectors. Also, the sides may be provided with a plurality of holes to selectively position boss in order to adjust the beater angle or rest position.
11. Rather than using a conventional connecting strap and cam, a sprocket and sprocket chain may be used.
12. The spreader, joining the heel plate to the base or support means, may be adjustable in length, thereby providing means to adjustably position the front of the pedal under the positionable rolling means.
13. Rather than using pinion racks secured to the platforms, the platforms may be toothed on their surface, thus eliminating problems which may result from using pinion racks.
14. Instead of having the track means extend over the standards, the supports may be rectangular in shape with their tops providing teeth.
15. Rather than using a loop as a coupling, a cable or chain may be used, which would loop around an eccentric disk or sprocket fixed adjacent to the rolling means.
16. The torque means may be provided by a rod eccentrically joined to and extending between the spaced pinions or pinion fashionings whereby the connecting would run over the eccentric rod and be adjustably fixed to the shaft by suitable means.
17. Toothed rails may be used rather than pinion racks or fashionings thereof. The rolling means would be spool or "T" shaped to prevent it from sliding in the axial direction.
18. Guides may be provided at the sides of the pinions or cylinder in the form of washers to prevent the pinions or fashionings thereof from sliding in the axial direction.
19. The tension springs may be vertically disposed adjacent to the inner sides of the spaced supports and eccentrically joined to coinciding extensions provided by the rolling means or to the bottom of a cylinder.
20. The pinions, pinion racks, and their variations may be of a variety of materials i.e., nylon or steel or rubber, and may be of any size to provide maximum performance.
21. Rather than a set screw, other means to secure and align pinions, pinion racks, and their variations may be used comprising of alteration by machining and use of guide pins, clips, castings, or adjustment screws.
22. The teeth of pinions and variations could provide a means of alignment and selective adjustment by engaging with a projection i.e., a pin provided by the sectors, shaft or a mounting thereon.
23. Rather than using a sector on each side of the rolling means, an axial extention may be used in place of one of the sectors. The axial extention would suitably carry the coupling to maintain engagement between the rolling means and track means but would offer no retraction or resistance thereby reducing the force needed to operate the pedal.

Due to the number of variations, it is intended that the present invention be considered as broadly as permitted by the appended claims.

What is claimed is:

1. A foot-operated bass drum pedal comprising:

(A) a base supported by the floor;
(B) a clamp for securing said base to the hoop of a vertically positioned bass drum, said clamp to be provided by said base;
(C) support means extending vertically from said base;
(D) track means provided by said support means and extending in a horizontal plane, said track means to provide teeth to run in the axial direction of a rolling means;
(E) said rolling means to provide teeth to run in the axial direction, said rolling means to meshingly engage and roll along said track means in a straight line, said rolling means to roll in a forward and backward direction;
(F) a beater to be co-axially carried by said rolling means and to have a cycloidal stroke;
(G) a beater mounting means to be provided by said rolling means and adjustably fix stem of said beater to said rolling means;
(H) an inclined pedal with the front portion positioned below said rolling means;
(I) a heel plate pivotly joined to the back of said inclined pedal and supported by the floor;
(J) a spreader to position said inclined pedal and to secure said heel plate to the back of said base;
(K) an eccentric means to be provided by said rolling means whereby torque is created, said eccentric means to rotate in unison with said rolling means;
(L) a link means to connect the front of said inclined pedal to said eccentric means, said link means to be resistant to stretching;
(M) a resilient means to retract said rolling means, said resilient means to be eccentrically joined to said rolling means and to maintain engagement between said rolling means and said track means, said resilient means to establish a reset position at the point of least resistance;
(N) a tensioning means to be joined to said resilient means;
(O) said rolling means to roll forward along said track means by depresion of said inclined pedal, via said link means and eccentric means, thereby cycloidally rotating said beater into a vertical strike position;
(P) said rolling means to roll backward along said track means by release of said pedal, via said resilient means, thereby cyloidally rotating said beater out of said vertical strike position and into rest position.

2. A foot-operated base drum pedal as defined in claim 1, further comprising means to prevent disengagement of said rolling means from said track means.

3. A foot-operated bass drum pedal as defined in claim 2, wherein said means to prevent disengagement comprise of covers, said covers to enclose said spaced rolling means and said spaced track means, the sides of said covers are to be cut away to allow said spaced rolling means and their joining means to roll, without obstruction, in a forward and backward direction.

4. A foot-operated bass drum pedal as defined in claim 1, wherein said vertical support means comprise of spaced vertical standards.

5. A foot-operated bass drum pedal as defined in claim 1, wherein said track means to be spaced apart, said teeth provided by said track means are to be aligned.

6. A foot-operated bass drum pedal as defined in claim 5, wherein said spaced track means to comprise of pinion racks resting securely in channels provided by spaced platforms, said platforms to be integral with said vertical support means.

7. A foot-operated bass drum pedal as defined in claim 1, wherein said rolling means to be spaced apart, said spaced rolling means to be axially joined, said spaced rolling means to co-axially roll in unison, said teeth provided by said spaced rolling means to be aligned.

8. A foot-operated bass drum pedal as defined in claim 7, wherein said spaced rolling means are to be joined by a joining means, said joining means to provide said eccentric means and said beater mounting means.

9. A foot-operated bass drum pedal as defined in claim 8, wherein said spaced rolling means comprise of pinions fixed at the ends of said joining means.

10. A foot-operated bass drum pedal as defined in claim 9, wherein said joining means comprise of an axle, said axle to co-axially rotate a cam and a beater mounting hub fixed to said axle.

11. A foot-operated bass drum pedal as defined in claim 1, wherein said beater mounting means to comprise of a hole running transversly to the axis of said rolling means and a tightening screw to intersect said hole, said stem of said beater to be inserted into said hole and adjustably fixed by said tightening screw.

12. A foot-operated bass drum pedal as defined in claim 11, wherein said hole and said tightening screw are provided by a hub axially joined to said rolling means, said hub to co-axially rotate in unison with said rolling means.

13. A foot-operated bass drum pedal as defined in claim 1, wherein said eccentric means comprise of a cam, said cam to be axially joined to said rolling means and positioned over the front of said inclined pedal.

14. A foot-operated bass drum pedal as defined in claim 1, wherein said link means to be flexible.

15. A foot-operated bass drum pedal as defined in claim 14, wherein said flexible link means to comprise of a strap of synthetic material.

16. A foot-operated bass drum pedal as defined in claim 1, wherein said resilient means to be spaced apart.

17. A foot-operated bass drum pedal as defined in claim 16, wherein said spaced resilient means comprise of tension springs and means to eccentrically join said tension springs to said rolling means, said tension springs to be vertically disposed adjacent to said support means.

18. A foot-operated bass drum pedal as defined in claim 17, wherein said means to eccentrically join said resilient means to said rolling means comprise of an extention eccentrically carried by said rolling means and having a cycloidal movement, said extention to be selectively positionable to adjust said rest position and angle of said beater.

19. A foot-operated bass drum as defined in claim 18, wherein said extention comprises of a boss fixed to the periphery of spaced sectors which are co-axially rotated by said rolling means, said sectors with said boss to be adjacent to said spaced rolling means, said sectors to be downwardly positioned and to be axially extended to allow clearence with the side of said track means.

20. A foot-operated bass drum pedal as defined in claim 1, wherein said tensioning means comprise of tension screws provided by brackets extending from the sides of said support means, said tension screws and brackets to be positioned below said resilient means and joined to the bottom thereof.

* * * * *